United States Patent [19]

Pleska

[11] 4,332,749

[45] Jun. 1, 1982

[54] PROCESS FOR THE PRODUCTION OF POLYOLEFINE-BASED FIBRIDS, AND THE FIBRIDS OBTAINED

[75] Inventor: Jean-Pierre Pleska, Pâturages, Belgium

[73] Assignee: Hercules Incorporated, Wilmington, Del.

[21] Appl. No.: 142,996

[22] Filed: Apr. 23, 1980

[30] Foreign Application Priority Data

May 10, 1979 [FR] France ..... 79 12146

[51] Int. Cl.[3] ..... B01J 2/02

[52] U.S. Cl. ..... 264/13

[58] Field of Search ..... 264/13

[56] References Cited

U.S. PATENT DOCUMENTS

| | | | |
|---|---|---|---|
| 4,007,247 | 2/1977 | Ballard et al. | 264/13 |
| 4,013,751 | 3/1977 | Davis et al. | 264/140 |
| 4,107,243 | 8/1978 | Stearns et al. | 264/13 |
| 4,110,385 | 8/1978 | Sander et al. | 264/13 |
| 4,112,029 | 9/1978 | Sander et al. | 264/13 |
| 4,210,615 | 7/1980 | Engler et al. | 264/13 |
| 4,260,565 | 4/1981 | D'Amico et al. | 264/13 |

FOREIGN PATENT DOCUMENTS

| | | |
|---|---|---|
| 824531 | 5/1975 | Belgium . |
| 847491 | 4/1977 | Belgium . |
| 2176843 | 11/1973 | France . |
| 2246661 | 9/1974 | France . |
| 2223406 | 10/1974 | France . |
| 1444675 | 8/1976 | United Kingdom . |

*Primary Examiner*—James R. Hall

*Attorney, Agent, or Firm*—Spencer & Kaye

[57] ABSTRACT

Polyolefine-based fibrids are produced by the abrupt expansion of a liquid mixture of molten polyolefine and solvent, this mixture being at high temperature and high pressure. The mixture contains the solvent, a polyolefine of normal molecular weight and a polyolefine of low molecular weight onto which a polar monomer has been grafted. The fibrids obtained possess a high proportion of grafted polyolefine on their surface.

13 Claims, No Drawings

PROCESS FOR THE PRODUCTION OF POLYOLEFINE-BASED FIBRIDS, AND THE FIBRIDS OBTAINED

BACKGROUND OF THE INVENTION

The present invention relates to a process for the production of polyolefine-based fibrids and to the fibrids obtained; these fibrids possess an excellent compatibility with cellulosic paper pulp and thus lead to the production, from mixtures of these fibrids with cellulosic pulp, of mixed papers having improved characteristics. Moreover, these fibrids are easily suspended in water. Thus, they can easily be processed by the conventional papermaking techniques.

Various processes are known which permit the direct production of polyolefine fibrids which are compatible with cellulosic pulp and which can easily be suspended in water, these processes involving the known technique of the abrupt expansion of a solution of molten polymer by passing it through a suitable orifice.

Thus, Belgian Pat. No. 824,531, filed on Jan. 20, 1975 in the name of Solvay and Cie., proposes to produce this type of fibrid by subjecting, to abrupt expansion, a solution containing a polyolefine, which has been subjected to a prior oxidation treatment, and a polar monomer which can be grafted onto the polyolefine. This process involves carrying out two successive steps, which complicates the process and increases the cost price of the fibrids.

In order to avoid resorting to a process involving two successive steps, Belgian Pat. No. 847,491, filed on Oct. 21, 1976 in the name of Solvay and Cie., proposes to incorporate, in the molten polymer/solvent mixture subjected to the abrupt expansion, a polar monomer which can be grafted onto the polymer used, and to cause the grafting onto the polymer before the abrupt expansion. However, this process exhibits another serious disadvantage. In fact, a secondary reaction in which the polar monomer is grafted onto the solvent causes the formation of oligomers, consisting of grafted solvent, which are subsequently found in the water in which the fibrids produced are suspended, and the hydrolysis of which leads to corrosive products. This reaction obviously also causes the loss of some of the polar monomer and some of the solvent.

The known processes also exhibit a common disadvantage, namely that the grafted polyolefine is grafted throughout its bulk, whereas, in order to ensure an adequate compatibility between the polyolefine fibrids and the cellulosic pulp and the ease of suspending the fibrids in water, it suffices for the fibrids to be grafted on their surface. The known processes thus involve the use of a large excess of polar monomer, relative to the amount which is actually necessary.

SUMMARY OF THE INVENTION

The aim of the present invention is to provide a process for the direct production of fibrids which possess an excellent compatibility with cellulosic fibres and which can very easily be suspended in water, which process no longer exhibits the abovementioned disadvantages of the known processes.

For this purpose, the invention relates to a process for the production of polyolefine-based fibrids by the abrupt expansion of a liquid mixture of molten polyolefine and solvent, by passing through an orifice, the mixture being under pressure and temperature conditions which are such that the abrupt expansion causes the instantaneous vaporisation of the solvent and the solidification of the polyolefine in the form of fibrids, in accordance with which process a mixture containing a polyolefine of normal molecular weight, the solvent and a polyolefine of low molecular weight, onto which a polar monomer has been grafted, is subjected to abrupt expansion.

DETAILED DESCRIPTION OF THE INVENTION

The term "fibrids" is understood as designating elongate fibrillar structures consisting of very thin filaments which have a thickness of the order of one micron and are connected to one another in order to form a three-dimensional system. The length of these fibrids, which have a flake-like appearance, varies from 1 mm to 5 cm and their diameter varies from about 0.01 to 5 mm. The specific surface area of these fibrids is more than 1 $m^2/g$.

The liquid mixture subjected to abrupt expansion comprises at least one liquid phase, based on organic solvent and polyolefine, which can be the sole liquid phase. The mixture can also consist of a system of two liquid phases (biphase mixture), namely a continuous phase rich in polyolefine, in which droplets of a liquid phase poor in polyolefine are dispersed.

The form in which the liquid mixture subjected to abrupt expansion is present depends on the pressure, the temperature and the polyolefine concentration. In general, the liquid mixture is preferably present in the form of a biphase mixture and the pressure, the temperature and the polymer concentration are chosen accordingly. The temperature is generally between 100° and 300° C. and preferably between 125° and 250° C. The polyolefine concentration in the mixture is generally between 1 and 500 g per kg of solvent; mixtures containing from 10 to 300 g of polyolefine per kg of solvent are preferably employed, the best results being obtained for concentrations of 50 to 200 g/kg. The pressure applied to the mixture is generally between atmospheric pressure and 100 atmospheres. It is preferably between 5 and 80 atmospheres.

Of course, the chosen temperature and pressure must also be sufficiently high for expansion of the mixture to cause the instantaneous vaporisation of the organic solvent, and sufficiently low for expansion to cause the solidification of the polyolefines present in the mixture.

If it is desired to employ the mixture in the biphase form, it is frequently advantageous to subject a mixture consisting of a single liquid phase to a pre-expansion, the mixture being at a higher pressure. The value of the pressure at which this pre-expansion is to be carried out can easily be determined experimentally by subjecting a portion of the mixture, which is at higher pressure, to progressive expansion and noting the pressure at which the mixture becomes turbid.

All polyolefines are suitable for preparing the liquid mixture. For example, high-density or low-density polyethylene, polypropylene, polystyrene, poly-4-methylpent-1-ene, syndiotactic polybutadiene or polybuta-1,4-diene can be used. However, homopolymers and copolymers derived from alpha-monoolefines containing from 2 to 6 carbon atoms in their molecule are preferred. Excellent results have been obtained with polymers derived from ethylene and propylene. The use of several different polyolefines is in no way excluded.

The organic solvent used to prepare the mixture can be chosen from amongst the solvents generally used for this purpose. In general, these solvents do not dissolve more than 50 g/liter, and preferably not more than 10 g/liter, of polymer, under normal temperature and pressure conditions (20° C., 1 atmosphere). Furthermore, at normal pressure they have a boiling point which is at least 20° C., and preferably more than 40° C., below the melting point or plasticisation point of the polymer. Finally, they make it possible to form a liquid biphase mixture under the operating conditions just before abrupt expansion.

Amongst the organic solvents which can be used, there may be mentioned aliphatic hydrocarbons, such as pentane, hexane, heptane, octane and their homologues and isomers, alicyclic hydrocarbons, such as cyclohexane, aromatic hydrocarbons, such as benzene and toluene, halogenated solvents, such as chlorofluoromethanes, methylene chloride and ethyl chloride, alcohols, ketones, esters and ethers. Aliphatic hydrocarbons, and in particular pentane and hexane, are preferably used. The use of mixtures of solvents also falls within the scope of the invention.

During abrupt expansion of the mixture, the applied pressure is reduced to a value of the order of atmospheric pressure, preferably to an absolute pressure below 3 kg/cm$^2$, in the course of a very short interval of time which is preferably less than 1 second. This expansion is achieved by passage through a preferably cylindrical orifice, the diameter of which is between 0.1 and 20 mm and preferably between 0.5 and 10 mm, and the ratio length/diameter of which is between 0.1 and 10 and preferably between 0.5 and 2. This abrupt expansion can advantageously be carried out using the process and device described in detail in Belgian Pat. No. 824,484, filed on Jan. 17, 1975 in the name of Solvay and Cie.

According to the invention, the liquid mixture subjected to abrupt expansion contains a polyolefine of normal molecular weight and a polyolefine of low molecular weight.

The term polyolefines of normal molecular weight is understood as designating polyolefines, such as defined above, of which the number-average molecular weight ($\overline{M}_n$) is more than 10,000 and preferably more than 12,000. The best results have been obtained when this molecular weight is more than 15,000.

The term polyolefines of low molecular weight is understood as designating polyolefines, such as defined above, of which the number-average molecular weight ($\overline{M}_n$) is less than 10,000 and preferably less than 8,000. The best results have been obtained when this molecular weight is less than 5,000 and more particularly with crystalline polyolefine waxes.

The number-average molecular weight is defined by the relationship $$\overline{M}_n = \frac{\epsilon N_i M_i}{\epsilon N_i},$$

in which $N_i$ represents the number of molecules of molecular weight $M_i$. This number-average molecular weight is determined in a known manner by cryoscopic and ebullioscopic methods, by the end-group method or also by osmometry.

The polyolefine of low molecular weight can be of a different type from the polyolefine of normal molecular weight forming part of the composition of the mixture subjected to abrupt expansion, but is preferably of an identical type.

The polyolefine of low molecular weight can be manufactured in a known manner by controlled polymerisation of the corresponding alpha-monoolefine or alpha-monoolefines or by controlled depolymerisation (for example by thermal degradation, by irradiation or by oxidation) of the corresponding polyolefines of higher number-average molecular weight.

The use of several different polyolefines of low molecular weight is not excluded from the scope of the invention.

A polar monomer is grafted onto the polyolefine of low molecular weight employed according to the invention. The grafting monomer is generally a monomer which possesses a double bond and groups capable of reacting with the hydroxyl groups of the cellulose, and which does not easily undergo homopolymerisation.

The preferred monomers are acrylic and methacrylic monomers, such as alkyl acrylates and methacrylates, glycidyl acrylate and methacrylate and alpha-chloroacrylic acid, and also allyl monomers and unsaturated polycarboxylic acids, such as maleic acid, fumaric acid and itaconic acid, and their derivatives, such as the corresponding anhydrides.

The best results have been obtained with maleic anhydride.

The use of several polar monomers also falls within the scope of the invention.

The reaction in which the monomer is grafted onto the polyolefine can be initiated by free radicals generated in a known manner, for example by means of high-energy radiation, by prior oxidation of the polyolefine (for example by ozonisation) or also by introducing a free radical generator into the medium containing the polyolefine, this last method being preferred.

Numerous types of free radical generators can be used for this purpose. Examples which may be mentioned are organic peroxides, such as di-tert.-butyl, lauroyl, benzoyl and acetylcyclohexanesulphonyl peroxides, peroxydicarbonates, such as diethyl and dicetyl peroxydicarbonates, peresters, such as tert.-butyl perpivalate, and azo-bis-nitriles, such as azo-bis-2,4-dimethylvaleronitrile and azo-bis-isobutyronitrile. Preference is given to free radical generators having a half-life of about 10 minutes at 160° C.

The grafting reaction is carried out so as to obtain a polyolefine of low molecular weight which generally contains from 0.01 to 10% by weight of grafted polar monomer and preferably from 0.1 to 5% by weight. The best results have been obtained when the proportion of grafted polar monomer in the polyolefine is between 0.5 and 3%. Excessively low proportions of polar monomer do not ensure adequate compatibility with cellulosic paper pulp. Excessively high proportions can lead to fibrids which are too short and too highly coloured.

It will be noted that, in the specific case of propylene polymers, the grafting of the polar monomer generally causes depolymerisation; in this case, it is not therefore essential to employ a polymer of low molecular weight because this property is acquired during the grafting itself. However, even in this case, it is preferred to carry out the grafting of the polar monomer onto propylene polymers of low molecular weight, such as defined above, because the grafting is more efficient and because the operation is more economical.

The grafting of the polar monomer onto the polyolefine of low molecular weight can be carried out in accordance with the known processes; it can be carried out in an organic solvent such as those listed above in connection with the preparation of the liquid mixture subjected to abrupt expansion; it can be carried out on the molten polyolefine in the malaxating zone of an extruder; it can also be carried out in the liquid mixture subjected to abrupt expansion, as described in the above-mentioned Belgian Pat. No. 847,491. Preferably, the grafting of the polar monomer onto the polyolefine of low molecular weight is carried out by malaxating them in such proportions and for such a time as are required in order to obtain the abovementioned proportions of grafted polar monomer, at a temperature which is preferably above the melting point of the polyolefine of low molecular weight, and, if appropriate, in the presence of a free radical generator such as those defined above.

The method of incorporation of the polyolefine of low molecular weight into the liquid mixture subjected to abrupt expansion is not critical. The polyolefine of low molecular weight can be mixed, either before the polar monomer is grafted onto it or in the grafted state, with the polyolefine or organic solvent forming part of the composition of the liquid mixture, or it can also be mixed directly with the latter, at any moment preceding the abrupt expansion.

For practical reasons, the preferred procedure consists in directly incorporating the polyolefine of low molecular weight, grafted beforehand and in the molten state, into the mixture of polyolefine of normal molecular weight and organic solvent, this mixture being in the liquid state.

This incorporation can be carried out by means of any appropriate device, such as, for example, a metering pump, the capacity of which is adjusted in accordance with the throughput of liquid mixture, in order to ensure the desired ratio between the respective amounts of grafted polyolefine of low molecular weight and of liquid mixture containing the polyolefine of normal molecular weight. Preferably, when the polyolefine of low molecular weight is introduced into the liquid mixture, the resulting mixture is homogenised, for example by means of a static mixer.

The proportion of grafted polyolefine of low molecular weight and of polyolefine of normal molecular weight in the liquid mixture subjected to abrupt expansion is chosen in accordance with the proportion of polar monomer in the polyolefine of low molecular weight and with the final proportion of polar monomer which it is desired to introduce into the fibrids produced according to the invention. In general, the amount of grafted polyolefine of low molecular weight does not represent more than 50% of the total weight of the polyolefines present in the liquid mixture subjected to abrupt expansion. Preferably, this amount is between 5 and 40% by weight.

The use of polyolefines of normal molecular weight which have also been modified by the grafting of a polar monomer is not excluded from the scope of the invention. In particular, the grafting of at least some of the polar monomer onto the polyolefine of normal molecular weight is inevitable when the grafting of the polar monomer onto the polyolefine of low molecular weight is carried out in the liquid mixture subjected to abrupt expansion. However, for carrying out the process according to the invention, it is preferred to use polyolefines of normal molecular weight onto which a polar monomer has not been grafted.

In addition to the polyolefines and the organic solvent, the liquid mixture subjected to abrupt expansion can of course contain other customary additives, such as heat stabilisers or light stabilisers, reinforcing agents, fillers, pigments, dyestuffs, antistatic agents, nucleating agents and the like.

The invention also relates to the fibrids obtained in accordance with the process described above. Surprisingly, these fibrids possess a heterogeneous structure. In fact, their constituent filaments have a composition which is not the same in the core and on the surface. In the core, they consist mainly of polyolefine of normal molecular weight. On the surface, they consist mainly of polyolefine of low molecular weight onto which a polar monomer has been grafted.

Mixing fibrids according to the invention with conventional cellulosic pulps leads to papers having properties which are frequently superior to those of papers produced solely from these cellulosic pulps, which demonstrates that their chemical reactivity towards cellulosic fibres is substantially improved. Moreover, these mixed papers possess improved surface properties which render them particularly suitable for use as printing papers and writing papers.

The papers formed can be subjected to thermal consolidation at a relatively high temperature capable of causing at least partial melting of the fibrids.

However, it is possible to avoid this heat treatment and nevertheless to obtain an effective bond by reacting the grafted fibrillar structures in the presence of a suspension of cellulosic fibres in an anhydrous organic solvent containing an acid esterification catalyst.

The thermal consolidation treatment can also be avoided if a hydroxylic coupling agent of high mobility is incorporated into the mixture of fibrids according to the invention and the suspension of cellulosic fibres in a liquid.

Starch and its derivatives, cellulosic derivatives, polyvinyl alcohols having a high hydrolysis level and a low molecular weight, polyethylene glycol, polypropylene glycol, and a nitrogen-containing derivative, such as casein, may be mentioned, in particular, as suitable coupling agents in the process according to the invention.

The suspension medium can be water or an organic solvent in which the coupling agent is soluble.

The amount of coupling agent employed can vary between 1 and 50% by weight of the dry weight of the fibrids employed.

Using this procedure, it is found that the papers produced possess good mechanical properties to the point that thermal consolidation is no longer essential.

Furthermore, when the fibrids according to the invention are dispersed or also when they are mixed with cellulosic pulps, it is also possible to incorporate, into the dispersion medium, compounds capable of reacting both with the hydroxyl groups of the cellulose and with the reactive groups of the grafted monomer or monomers. For this purpose, for example, it proves very advantageous to incorporate a polyamide modified, for example, by epichlorohydrin or a urea/formaldehyde resin.

The process and the fibrids according to the invention are illustrated by the non-limiting practical illustrative embodiments which follow.

EXAMPLES 1 to 3

Example 1 is given by way of comparison.

Biphase mixtures are prepared by bringing mixtures comprising:

a high-density polyethylene marketed by Solvay and Cie. under the name ELTEX A 1050, and technical-grade hexane sold by ESSO under the name ESSO D.A "polymerisation grade", to a temperature of 195° C. and to a pressure of 75 bars.

The following constituents are added, respectively, to these mixtures:

Example 1: The high-density polyethylene defined above, onto which 2% by weight of maleic anhydride has been grafted, at about 180° C., in the malaxating zone of an extruder, in the presence of 0.25% by weight of di-t-butyl peroxide.

Example 2: High density polyethylene marketed by Solvay and Cie. under the name ELTEX A 3400 and grafted as indicated above.

Example 3: A polyethylene wax (the product EPOLENE N 14 from EASTMAN CHEM. PROD.) onto which 2.5% by weight of maleic anhydride has been grafted, at 180° C., in a stirred vat under an absolute pressure of 2 atmospheres, in the presence of 0.25% by weight of 2,5-di-(t-butylperoxy)-hexane.

These mixtures are expanded by passage through a die having a perturbation chamber, such as that described in Belgian Pat. No. 824,484, filed on Jan. 17, 1975 in the name of Solvay and Cie., with reference to FIG. 13 of that patent (the diverging nozzle extending the abrupt expansion orifice has an opening of 150° and the biphase mixture is discharged at a rate of 15 kg/hour of polymer), so as to obtain fibrids having an average length of about 5 mm.

The particular conditions of each experiment and their results are recorded in the table below.

TABLE

| EXAMPLE | 1 | 2 | 3 |
|---|---|---|---|
| Total proportion of polyethylenes in the mixture | about 10% by weight | | |
| Proportion of maleic anhydride in the grafted polyethylene (% by weight) (1) | 1.5 | 1.5 | 0.94 |
| Number-average molecular weight of the grafted polyethylene ($\overline{M}_n$) | 13,500 | 7,000 | 1,800 |
| Proportion of grafted polyethylene in the mixture of polyethylenes (% by weight) | 33 | 35 | 32 |
| Proportion of grafted polyethylene on the surface of the fibrids obtained (% by weight) (2) | 0.22 | 0.35 | 0.35 |
| Percentage of the total grafted polyethylene present on the surface of the fibrids | 44% | 70% | 100% |

(1) determined by infrared spectrometry (2) determined by titrimetry, after extraction of the fibrids with alcohol in order to remove any trace of free maleic anhydride.

Examination of these results allows the conclusion that the proportion of the grafted polyethylene present on the surface of the fibrids is greater when the number-average molecular weight of the grafted polyethylene decreases. When this molecular weight is sufficiently low, all the grafted polymer is located on the surface of the fibrids.

Example 4

A biphase mixture is prepared by bringing to a temperature of 170° and a pressure of 75 bars, a mixture comprising:

12% by weight of polypropylene marketed by HERCULES under the name Profax 6501,

85% by weight of technical-grade pentane, and

3% by weight of a polypropylene wax marketed by SANYO under the name Viscol 550 P and grafted in the same manner as the polyethylene wax in Example 3.

The proportion of maleic anhydride in the grafted polypropylene wax was about 2.5%.

After expansion of the liquid mixture as mentioned in the preceding examples, examination of the fibrids by titrimetry makes it possible to observe that the proportion of grafted polypropylene on their surface is about 0.45% by weight; thus, 90% of all the grafted polypropylene is present on the surface of the fibrids.

I claim:

1. In a process for the production of polyolefine-based fibrids by the abrupt expansion of a liquid mixture of molten polyolefine and solvent, by passage through an orifice, the mixture being under pressure and temperature conditions which are such that the abrupt expansion causes the instantaneous vaporisation of the solvent and the solidification of the polyolefine in the form of fibrids, the improvement comprising subjecting to abrupt expansion a liquid mixture containing (1) a polyolefine of normal molecular weight, (2) said solvent and (3) a polyolefine of low molecular weight, onto which a polar monomer has been grafted.

2. Process according to claim 1, wherein the polyolefine of low molecular weight is an olefine polymer derived from ethylene and propylene.

3. Process according to claim 1 or 2, wherein the polyolefine of low molecular weight has a number-average molecular weight of less than 8,000.

4. Process according to claim 1 or 2, wherein the polyolefine of low molecular weight is a crystalline polyethylene wax or crystalline polypropylene wax.

5. Process according to claim 1 or 2, wherein said polar monomer comprises maleic anhydride.

6. Process according to claim 1 or 2, wherein the proportion of polar monomer in the grafted polyolefine of low molecular weight is between 0.1 and 5% by weight.

7. Process according to claim 1 or 2, wherein the amount of grafted polyolefine of low molecular weight in the liquid mixture is between 5 and 40% of the total weight of the polyolefines present in the mixture.

8. Process according to claim 1 or 2, wherein a polar monomer has not been grafted onto the polyolefine of normal molecular weight.

9. Process according to claim 1 or 2, wherein the grafted polyolefine of low molecular weight is manufactured by malaxating a mixture comprising the polyolefine of low molecular weight and the polar monomer at a temperature above the melting point of the polyolefine of low molecular weight.

10. Process according to claim 9, wherein the mixture which is malaxated additionally comprises a free-radical generator.

11. Process according to claim 10, wherein the polyolefine of normal molecular weight has a number-average molecular weight greater than 15,000 and the polyolefine of low molecular weight has a number-average molecular weight of less than 5,000.

12. Process according to claim 1 or 2, wherein the polyolefine of low molecular weight has a number-average molecular weight of less than 8,000 and the proportion of polar monomer in the grafted polyolefine of low molecular weight in between 0.1 and 5% by weight.

13. Process according to claim 12, wherein said polar monomer comprises maleic anhydride.

* * * * *